United States Patent [19]

Schippers

[11] 4,408,377

[45] Oct. 11, 1983

[54] STUFFING CHAMBER TEXTURIZING PROCESS

[75] Inventor: Heinz Schippers, Remscheid, Fed. Rep. of Germany

[73] Assignee: Barmag Barmer Maschinenfabrik AG, Remschied-Lennep, Fed. Rep. of Germany

[21] Appl. No.: 222,600

[22] Filed: Jan. 5, 1981

Related U.S. Application Data

[63] Continuation of Ser. No. 927,014, Jul. 24, 1978, abandoned.

[30] Foreign Application Priority Data

Jul. 25, 1977 [DE] Fed. Rep. of Germany ..... 2733455

[51] Int. Cl.[3] ..... D02G 1/12

[52] U.S. Cl. ..... 28/250; 28/264

[58] Field of Search ..... 28/248, 250, 251, 264, 28/221

[56] References Cited

U.S. PATENT DOCUMENTS

| | | | |
|---|---|---|---|
| 2,734,252 | 2/1956 | Shattuck | 28/250 |
| 3,037,260 | 6/1962 | Pike, Jr. | 28/250 |
| 3,200,467 | 8/1965 | Iwnicki et al. | 28/250 |
| 3,200,467 | 8/1965 | Iwnicki et al. | 28/250 |
| 3,311,961 | 4/1967 | Iwnicki et al. | 28/250 |
| 3,406,436 | 10/1968 | Clarke, Jr. | 28/250 |
| 3,526,023 | 9/1970 | Mertens | 28/248 |
| 4,162,564 | 7/1979 | Stanley | 28/250 |

FOREIGN PATENT DOCUMENTS

| | | | |
|---|---|---|---|
| 679584 | 2/1964 | Canada | 28/250 |
| 1551651 | 11/1968 | France | 28/251 |
| 48-30022 | 9/1973 | Japan | 28/250 |
| 49-104 | 1/1974 | Japan | 28/250 |
| 964910 | 7/1964 | United Kingdom . | |
| 1166720 | 10/1969 | United Kingdom | 28/251 |

*Primary Examiner*—Robert Mackey
*Attorney, Agent, or Firm*—John H. Shurtleff

[57] ABSTRACT

A process for stuffer box crimping of a yarn of synthetic thermoplastic filaments wherein the discharge resistance on the yarn plug formed in the stuffing chamber is increased or reduced in response to a continuously measured value of advancing pressure of the yarn plug within the stuffing chamber, preferably in response to the frictional force between the yarn plug and an axially movable inner wall surface of the stuffing chamber. Suitable measuring and control means may be provided to increase or decrease the discharge resistance in response to the difference between the measured value of the advancing pressure and a predetermined constant value.

7 Claims, 6 Drawing Figures

STUFFING CHAMBER TEXTURIZING PROCESS

This is a continuation of application Ser. No. 927,014 filed July 24, 1978, now abandoned.

INTRODUCTION

This invention relates to a stuffing chamber texturizing process and apparatus which is particularly adapted to carry out this process.

BACKGROUND OF THE INVENTION

The texturizing of synthetic yarns, as continuous filaments, threads, tows or the like, in a stuffing chamber is commonly referred to as "stuffer-box crimping" and has been described in detail in such references as "Woven Stretch and Textured Fabrics", by Hawthrone, Interscience Publishers Division of John Wiley & Sons, N.Y. (1964), Chapter 4, pages 78–89, and more recently in "Textile Yarns" by Gosivami et al, John Wiley & Sons, N.Y. (1976), pp. 444–446. In general, the known stuffing chamber texturizing processes and apparatus feed the yarn at a high speed, e.g. by suitable nip rolls, into a confined tubular space where the yarn is compressed into a yarn plug in which the individual filament or filaments are curled, looped or folded over so as to be crimped. At or near the outlet end of the tubular space, the crimped yarn is withdrawn through a weighted tube or another braking device which restricts the tubular cross-section and places a discharge resistance on the yarn plug as it advances in the tubular space under the influence of the impinging force of the feed yarn.

The regulation of the stuffing pressure or so-called back pressure in stuffing chambers is controlled in a known manner by varying the outlet or discharge resistance of the upsetting chamber. In this case, the amount of pressure used is dependent primarily on the desired elastic properties and the voluminosity or bulk of the final texturized product. Of importance here is not only the regulatable back pressure at the outlet portion of the stuffing chamber, but also the friction of the advancing yarn plug on the interior wall surface of the stuffing chamber. Since the properties of the outer circumferential surfaces of the advancing yarn plug can fluctuate, the quality and specific characteristics of the texturized yarn may change in spite of an optimum setting of the back pressure.

BRIEF DESCRIPTION OF THE INVENTION

The object of the invention is to provide a stuffer box texturizing process and apparatus wherein undesirable frictional effects in the stuffing chamber can be determined and eliminated. More particularly, it is an object of the invention to provide a process and apparatus in which it is possible to accurately measure the frictional force between the advancing yarn plug and the inner wall surface of the stuffing chamber and to use this measurement to control the discharge resistance exerted on the yarn plug in the outlet section of the stuffing chamber.

In accordance with the invention, it has now been found that the stuffer box crimping process is substantially improved and an advantageous apparatus is provided by observing the particular novel features and limitations defined by the claims appended hereto.

In the crimping process of the invention, wherein the yarn is continuously fed into a stuffing chamber having a defined interior cross-section to form an accumulated yarn plug of looped, crimped or bent filaments compressed after an initial crimping point, said yarn plug being advanced from an entry section to an outlet section of the stuffing chamber by the force of the fed yarn entering said chamber, and braking the advancing movement of the yarn plug by exerting a discharge resistance thereagainst in the outlet section of the chamber, the improvement is essentially one which comprises the steps of (1) continuously measuring the advancing pressure of said yarn plug in said chamber after the crimping point where said plug is first formed, as viewed in the direction of yarn feed, and (2) increasing or reducing the discharge resistance on said yarn plug in response to the measured amount of said advancing pressure of the yarn plug. In this process, the measured value of the advancing pressure is preferably compared with a predetermined constant value, and the discharge resistance is increased or reduced in response to the difference between said measured value and said predetermined constant value.

The advancing pressure of the yarn plug can be measured as the frictional force produced by the pressure between an interior wall of the stuffing chamber, preferably the interior wall of the outlet section of the chamber, and the outer surface of the yarn plug which is in contact with said interior wall. Any axially slidable contact surface which forms at least part of the interior wall surface of the chamber, especially the outlet section thereof, may serve as a measure of the frictional force or advancing pressure of the yarn plug. The measurement may be made of a pressure exerted by the movable wall surface, or it is also possible to measure the axial displacement of this wall surface. In either case, the measured value of the advancing pressure or axial displacement can be compared to a predetermined constant value, i.e. a constant pressure value or a constant positional value, with the discharge resistance being increased or decreased in direct response to the difference between the measured value and the constant value.

It is also advantageous for purposes of the invention to provide means to dampen the axial movement of the movable inner wall surface of the stuffing chamber, such dampening means preferably being incorporated in the accumulator means, e.g. by use of a viscous oil or other hydraulic fluid therein.

Although the stuffing box crimper used to carry out the process of the present invention can be widely varied in its basic structure and design, it has been found to be especially advantageous to provide a stuffing chamber which comprises an elongated tube of rectangular, square or circular cross-section having two axially separable parts corresponding to its entry section and outlet section, respectively, the entry section being mounted in a stationary position and the outlet section being mounted for axial displacement in the advancing direction of the yarn plug so as to provide the axially movable inner wall surface of the required measuring means. The adjoining or abutting surfaces of the entry section and the outlet section, which spread or open to form a widening seam during axial displacement of the outlet section, are inclined against the advancing direction of the yarn plug such that the plug slides smoothly over the seam. This slope or inclination prevents filaments from being trapped or snagged by the seam during operation. In one very useful embodiment of this preferred apparatus, the entry section and said outlet section have teeth projecting in the axial direction which cooperatively intermesh with each other to form a closed interior space surrounding the yarn plug. As the outlet section separates from the entry section, the seam or gap thus forms only where the crown of a tooth moves away from the root or base between two opposing teeth. The remaining wall space between the axially spaced and intermittent gaps remains completely closed where the sides of the teeth are in close sliding contact with each other.

Other than the stuffer box or stuffing chamber itself with the essential braking, measuring and control means associated therewith to balance and compensate for irregular movements or frictional forces of the yarn plug, the apparatus of the invention uses conventional equipment to spin, draw, heat and wind the yarn. The term "yarn" is used herein to include a monofilament although it is more conventional to subject a multifilament yarn as a thread, strand, tow or the like to a stuffer box crimping. Thermoplastic synthetic filaments are most commonly used for such crimping, since they may be heated to "fix" the crimp and thus ensure a durable crimping effect. A preheater may be used for this purpose or heating means may be incorporated directly into the stuffing chamber or "stuffer-box", e.g. by using a heating jacket, introducing steam or similar measures.

DESCRIPTION OF THE DRAWINGS

Particular embodiments of the invention are illustrated in the accompanying two sheets of drawings wherein.

Figure 2:
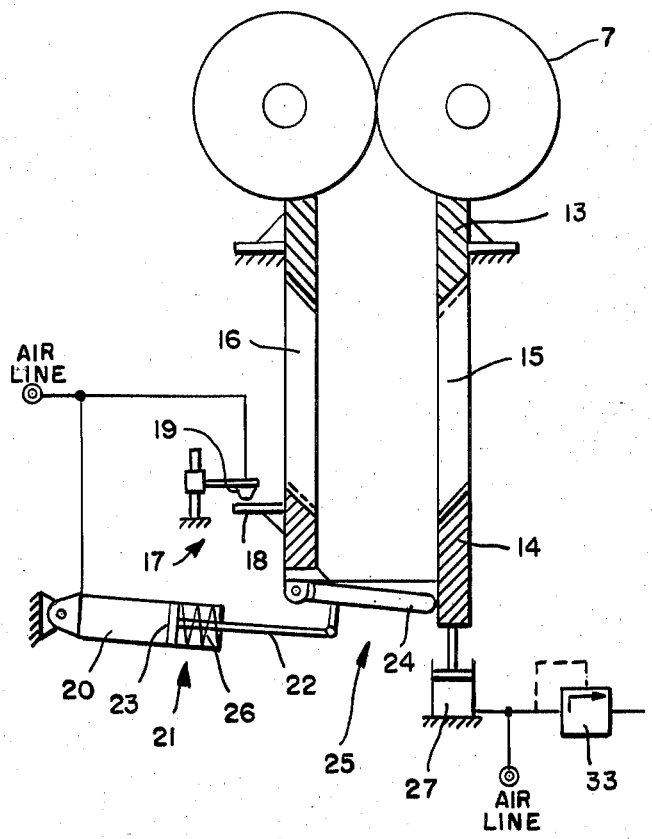
FIG. 2 is a partly schematic view of a preferred stuffing chamber with a mechanical measuring and control means according to the invention, the tubular chamber itself being shown in a cross-section taken along line II—II of FIG. *2a;*
Figure 2A:
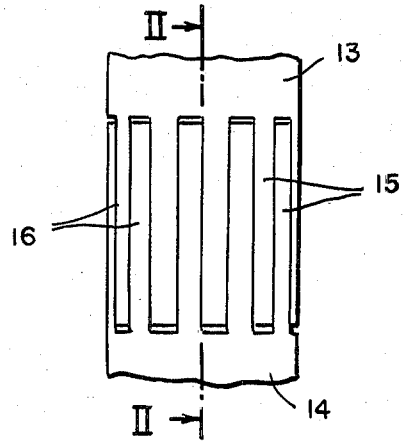
Figure 3:
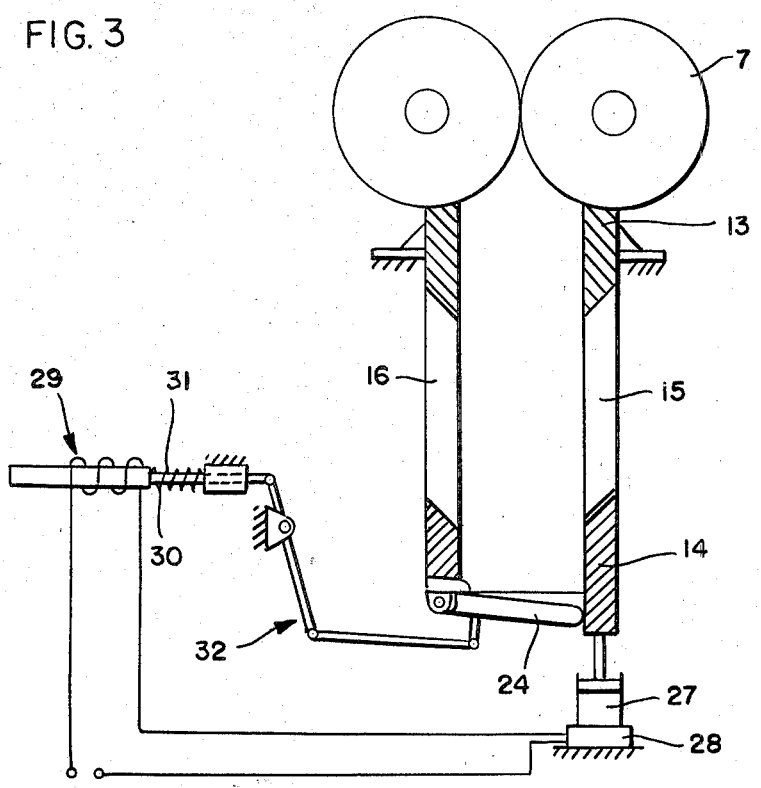
Figure 4:
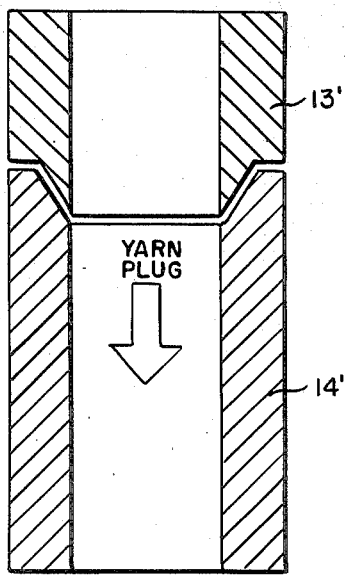
Figure 5:
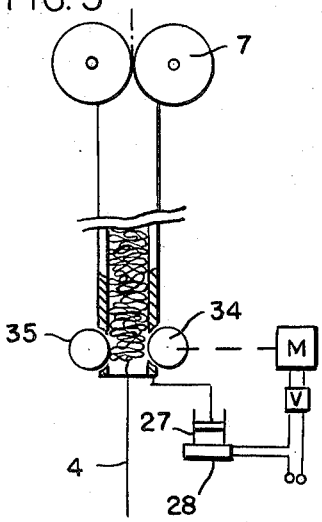

FIG. *2a* is an interior elevational view of a segment of the chamber wall to illustrate the preferred tongue-and-groove or intermeshing teeth engagement of the entry and outlet sections of the stuffing chamber;

FIG. 3 is a partly schematic representation of another preferred stuffing chamber similar to that of FIG. 2 but with an electrical measuring and control means according to the invention;

FIG. 4 is a cross-sectional view of another preferred construction of the entry and outlet sections of the stuffing chamber; and FIG. 5 is a partly schematic illustration of an alternative twin roller braking means with variable speed control for regulating the yarn plug advancement.

Figure 1:
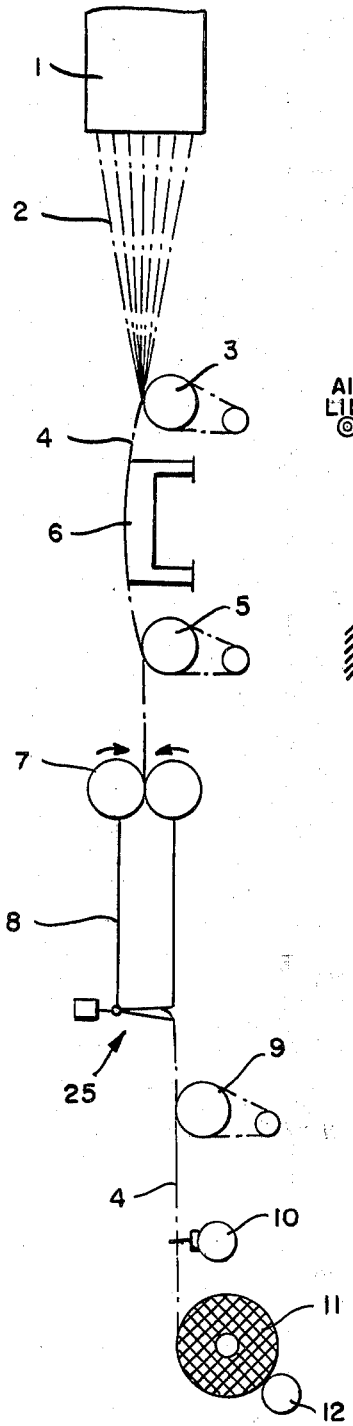
FIG. 1 is a schematic representation of the stuffer box crimping process at one spinning position where the yarn is a continuous multifilament yarn of a thermoplastic fiber-forming polymer.

Referring first to FIG. 1, a continuous spinning and stuffer box crimping operation is shown schematically, it being understood that the present invention can be adapted to this conventional operation as shown or as other similar operations. A spinning nozzle 1 is employed for melt spinning a plurality of filaments 2. By means of a stretching or drawing device consisting of the feed and draw godets 3 and 5, respectively, the filaments 2 are combined into the yarn 4 and drawn off over the heating device 6.

After the yarn 4 has been stretched while heated, it is transported at high speed into the stuffer box or stuffing chamber 8 by means of the nip rolls or stuffer feed rolls 7. Within the chamber 8, the yarn 4 is crimped into irregular loops or bends as it is propelled and compressed into a yarn plug which partly fills the chamber 8 in a conventional manner, i.e. following a crimping point just after the feed rolls 8. The draw-off godet 9 removes the texturized yarn 4 out of the stuffing chamber 8 at about the same rate that fresh yarn is introduced by the feed rolls 7. The traversing device 10 deposits the texturized yarn on the spool 11 which is driven by means of the drive roller 12.

One preferred stuffing chamber, arranged and used according to the invention, has a structure and regulating operation as shown in detail by FIGS. 2 and *2a*. In this case, the regulation of the stuffing chamber is accomplished by pneumatic means.

The stuffing chamber 8 has a rectangular or preferably a round cross-section as shown and consists of a stationary entry section or part 13 and an outlet section or part 14 movable axially in the advancing direction of the yarn. The entry section 13 as well as the outlet section 14 have prongs, tongues or teeth 15 and 16, respectively, which are aligned axially and arranged alternatingly to intermesh and form the walls along a middle portion or segment of the stuffing chamber 8. Teeth 15 and 16, respectively, are arranged in such a form-fitting manner along contacting sides as to provide a closed wall surface. The individual crowns or end surfaces of the teeth together with the opposing roots are designed and arranged in such a way that they do not hinder the advancing movement of the yarn plug.

The measuring device 17 set forth by FIG. 2 includes a deflection plate 18 firmly mounted on the outer circumference at one side of the outlet part 14 and arranged to cooperate with an axially positionable nozzle 19 which is located above the deflection plate at a predetermined gap or interval and is connected to a compressed air line as schematically shown. A stationary piston-cylinder unit 20 acts as an adjusting element 21 to control the yarn discharge from chamber 8 and is connected to the same compressed air line as the nozzle 19. The piston rod 22 of this control unit 20 is fastened flexibly or pivotally to the piston 23 as well as to the pressure lid, flap or door 24, which operates as a braking device 25 to control the stuffing pressure or advancing pressure of the yarn plug in the stuffing chamber 8. The piston 23 can be loaded with compressed air on one side as shown and is movable against the force of a spring 26 in such a way that upon release of the compressed air or a reduction of the air pressure, the door 24 is opened.

The outlet section or part 14 is held or supported by a second piston-cylinder unit 27 which is loaded on one side and can also be connected to the air pressure line as indicated. In this case, an adjustable excess-pressure valve 33 is provided so that the holding or supporting force in the cylinder 27 can be adjusted. Another preferred technique of producing the desired supporting or holding force consists in providing a piston-cylinder unit 27 which is loaded with an adjustable oil volume so that in addition to the supporting force, a damping can also be achieved based on the oil viscosity. By the use of a hydro-pneumatic accumulator such as 27, a suspension exhibiting very little friction can be obtained, and the axial movement or displacement of the outlet section 14 is made primarily dependent upon the frictional force exerted by the yarn plug on the inner wall surfaces of the outlet section 14. Such construction is necessary for a regulating device which will operate with absolute accuracy.

Before the stuffing chamber is placed into operation, the holding or supporting force is set in the piston-cylinder unit 27. Taking into consideration the volume of air which is supplied by the compressed air source, the gap or interval between the nozzle 19 and the deflection plate 18 is initially adjusted in such a way that the flap or door 24 can produce the desired braking pressure or discharge resistance on the yarn.

At the beginning of the operation of stuffing chamber 8, the yarn 4 is transported at high speed into the upsetting chamber by the paired feed rolls 7. Inside chamber 8, the yarn filaments pass through a crimping point and are compressed into a plug by the initial pressure or resistance of the door 24. Based on changes in the surface quality or condition of the yarn, for example, as caused by fluctuations when the yarn is moistened or by changes in the melt spinning parameters, the friction of the yarn on the interior wall of the stuffing chamber may substantially increase. The yarn plug may then stick or jam in the stuffing chamber 8, at least to the extent of seriously reducing the rate of advance of the yarn plug through the chamber. The plug becomes more compressed and harder so that the danger of a change in the elastic properties and the bulk or voluminosity of the texturized material can occur. Moreover, as yarn is conveyed into the stufffing chamber by the feed rolls 7, the yarn plug—because of the wall friction—will tend to drag the outlet section 14 along in the advancing or conveying direction. This axial displacement in the advancing direction does occur if the holding force produced in the cylinder 27 is exceeded. By the axial displacement of the outlet section 14, the gap between the nozzle 19 and the deflection plate 18 becomes larger so that sufficient compressed air no longer flows to the piston-cylinder unit 20 in order to supply the required braking pressure or discharge resistance through the pressure flap or door 24. Because of the reduced pressure in the piston-cylinder unit 20, the spring 26 moves piston 23 to the left so that the door 24 opens. Thereby the braking or discharge resistance is reduced. Moreover, the withdrawal forces of the draw-off godet 9 can be applied in their full magnitude to the yarn plug and thus remove the blocking or jamming layers of yarn without exceeding the permissible upper limit. Thus, yarn plug irregularities causing severe blockage or jams are completely avoided without damage to the yarn, and the uniformity of the crimp texturizing effect is substantially improved.

If the wall friction decreases, the predetermined holding force produced in the piston-cylinder unit 27 returns the outlet section 14 into its initial position whereby simultaneously the gap between the nozzle 19 and the deflection plate 18 again becomes smaller. With the decrease of this nozzle-plate gap, the air pressure in the piston-cylinder unit 20 increases so that the piston 23 can be moved to the right against the force of the spring 26, and the desired braking or discharge resistance is again built up by closing of the flap or door 24.

In FIG. 3, another embodiment of a regulating device is shown, using an electrical control system for balancing the influences of wall friction. In this case, a pressure-responsive transducer cell 28 is mounted below the piston-cylinder unit 27 producing the holding force, so as to furnish an electrical signal which is proportional to the amount of pressure applied thereto.

In this electrical control system of FIG. 3, the piston-cylinder unit 20 of FIG. 2 has been replaced by a solenoid unit 29 wherein an electrical coil acts to move out a rod 30 (iron core) against the force of a spring 31. The rod 30 operates the flap or door 24 by way of a suitable toggle or other linkage 32. By changing the initial tension or stress of the spring 31, the initial pressure or resistance of the door 24 can also be adjusted.

If the permissible amount of wall friction is exceeded because of an excessive transport of the yarn into the stuffing chamber 8, or as a result of jamming, the holding force exerted on the outlet section 14 by the unit 27 is overbalanced. The transducer 28 determines this force which is directed downward thereon. By way of solenoid 29 and the toggle 32, the flap or door 24 is opened against the force of spring 31. Here again, the withdrawal forces of the drawn-off godet do not have to be increased up to the permissible maximum, because the pulling of the thread out of the stuffing chamber is facilitated by the opening of the door 24. The normal withdrawal forces can then be used to quickly dissolve the jam or blocking of the yarn plug.

Still another alternative embodiment of the stuffing chamber 8 is illustrated in FIG. 4 with respect to the interfitting entry and outlet sections. In place of teeth 15, 16, the entry section 13' as well as the outlet section 14' has a fully closed wall around its periphery. The abutting or opposing end surfaces of the two sections 13', 14' form a seam or annular opening which widens as the two sections separate, but these surfaces are inclined for a smooth transport of the yarn plug past the seam. The wall of the outlet section 14' extends here somewhat further along the advancing direction of the yarn plug so that the influence of the wall friction can be determined over a greater axial length. The shorter length of the entry section 13' is still sufficient to provide a crimping point or zone immediately preceding the yarn plug in section 14'. The stuffing chamber illustrated in FIG. 4 can be combined with either of the regulating devices according to FIGS. 2 or 3.

In FIG. 5, another variation of a suitable braking or discharge limiting device is shown, preferably using a stuffing chamber 8 of rectangular cross-section with two opposing conveying rollers 34 and 35 mounted for rotation on either side of the chamber and driven by the variable speed motor M controlled by the variable speed adjusting unit V in response to the electrical signal transmitted by transducer or pressure cell 28, operating as an electrical system similar to that shown in FIG. 3. Preferably, the rollers 34 and 35 are arranged as shown so that their peripheral surfaces project slightly inside the chamber 8 in the outlet section thereof and remain in this fixed rotatable position. The motor M can then drive these rollers 34 and 35 in a direction which opposes the advancing movement of the yarn plug but with a variable speed so as to increase or decrease the braking pressure or discharge resistance. Other variations of this kind will be readily apparent from the foregoing description.

The use of an inner wall of the stuffing chamber, especially the outlet section thereof, for measuring the frictional force being exerted by the yarn plug represents a particular advantage in that it permits for the first time an accurate measure of this frictional force so as to be used in controlling the discharge resistance or braking effect applied at the exit portion of the chamber. Also, the apparatus of the invention, especially with an axially displaceable outlet section, has the advantage that it can be very economically and simply introduced into existing apparatus without changing the course of the thread or the arrangement of other complementary spinning, stretching and winding apparatus. Conventional regulating devices, i.e. pneumatic measuring, regulating or control devices or electrical measuring, regulating or control devices are equally useful in the stuffer crimping apparatus of the invention. In both cases, it is especially desirable to use a hydro-pneumatic accumulator equipped with a liquid damping means to maintain a steady supporting pressure or preset holding pressure against the normal advancing pressure of the yarn plug. Both a trouble-free operation and uniform crimping quality are then best achieved.

I claim:

1. In a stuffer box crimping process for texturizing a yarn of synthetic thermoplastic filaments wherein the yarn is continuously fed with crimping into an elongated stuffing chamber having an interior cross section defined by its inner walls to form an accumulated yarn plug of looped and compressed filaments, said yarn plug exerting irregular frictional forces on said inner walls while being advanced from an upstream stationary entry section to a downstream axially movable outlet section of said stuffing chamber by the force of the fed yarn entering the chamber, and braking the advancing movement of said yarn plug by exerting a discharge resistance thereagainst in said movable outlet section of the chamber, the steps which comprise:

applying the frictional force of the yarn plug as an advancing pressure exerted on a contact surface which forms at least part of the inner walls of said movable outlet section and which is axially movable relative to the inner walls of said stationary entry section;

applying an opposing force to said axially slidable contact surface of said outlet section in an axial direction against the advancing pressure of the yarn plug to counteract the advancing movement of said outlet section relative to said entry section;

continuously measuring and comparing the actual value of the advancing pressure of the yarn plug with a predetermined value, said measurement being effected by measuring said opposing force applied to said axially slidable contact surface; and adjusting the discharge resistance on said yarn plug in response to the difference between said actual value and said predetermined value, thereby compensating for the irregular frictional forces between said inner walls and said yarn plug.

2. A process as claimed in claim 1 wherein said yarn plug is braked by a movable door arranged to provide said discharge resistance adjacent the outlet end of the stuffing chamber.

3. A process as claimed in claim 2 wherein said movable door is hinged on said contact surface, thereby applying both the frictional force of the yarn plug and also the discharge resistance of said movable door as an advancing pressure exerted on said contact surface.

4. A process as claimed in claim 1 wherein said yarn plug is braked by two opposing conveying rollers arranged to provide said discharge resistance adjacent the outlet end of the stuffing chamber.

5. A process as claimed in claim 1 wherein said contact surface is supported by a pressure-actuated piston applying said opposing force.

6. A process as claimed in claim 5 wherein air pressure is used to actuate the piston.

7. A process as claimed in claim 5 wherein said piston is part of a piston-cylinder unit loaded with an adjustable oil volume, thereby damping the movement of the piston as it supports said contact surface.

* * * * *